US006105882A

United States Patent [19]

Woltjen

[11] Patent Number: 6,105,882

[45] Date of Patent: Aug. 22, 2000

[54] TEXTURE MATERIAL APPLICATOR

[75] Inventor: Duane W. Woltjen, Fayetteville, Ark.

[73] Assignee: Marshalltown Trowel Company, Marshalltown, Iowa

[21] Appl. No.: 09/200,537

[22] Filed: Nov. 25, 1998

[51] Int. Cl.[7] ..... B05B 1/16

[52] U.S. Cl. ..... 239/394; 239/390

[58] Field of Search ..... 239/390–394; 222/575, 565, 480

[56] References Cited

U.S. PATENT DOCUMENTS

| | | | |
|---|---|---|---|
| 12,831 | 5/1855 | Roberts . | |
| Re. 29,405 | 9/1977 | Gunzel, Jr. et al. | 239/318 |
| 3,982,698 | 9/1976 | Anderson | 239/394 |
| 4,111,368 | 9/1978 | Brehm | 239/394 |
| 5,232,161 | 8/1993 | Clemmons | 239/346 |
| 5,255,846 | 10/1993 | Ortega | 239/103 |
| 5,310,095 | 5/1994 | Stern et al. | 222/402.1 |
| 5,421,519 | 6/1995 | Woods | 239/394 |
| 5,524,798 | 6/1996 | Stern et al. | 222/402.1 |
| 5,639,026 | 6/1997 | Woods | 239/394 |
| 5,645,198 | 7/1997 | Stern et al. | 222/402.1 |

FOREIGN PATENT DOCUMENTS

| | | | |
|---|---|---|---|
| 1810119 | 4/1993 | U.S.S.R. | 239/394 |

*Primary Examiner*—Lesley D. Morris

*Attorney, Agent, or Firm*—McAndrews, Held & Malloy, Ltd.

[57] ABSTRACT

An orifice plate for a texture material applicator having a number of nozzle orifices of differing diameters. Each nozzle orifice is defined by a nozzle extending normally from the plate in the direction of texture material flow. The length of each nozzle is the sum of the thickness of the plate plus the extent of the nozzle beyond the plate. The total length of each nozzle is proportional to its exit diameter.

8 Claims, 2 Drawing Sheets

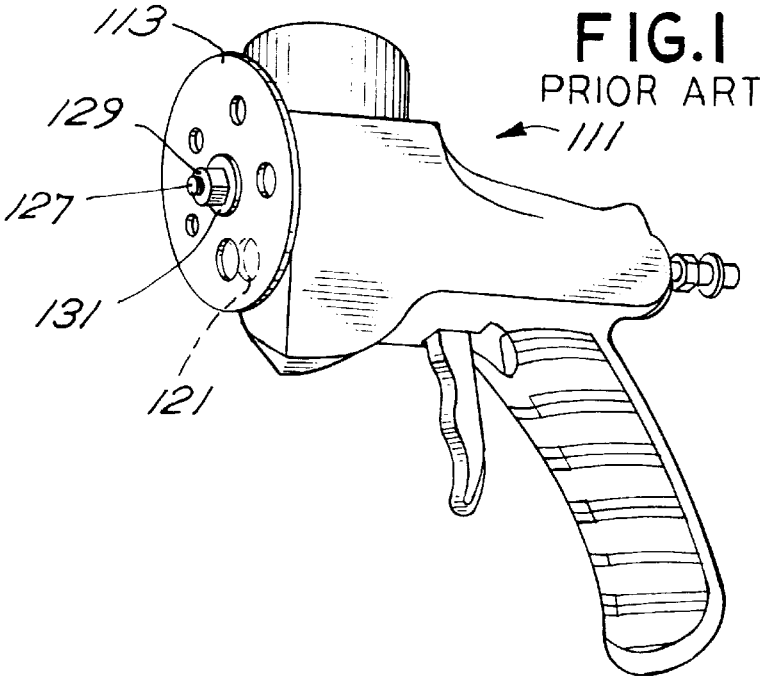
FIG.1
PRIOR ART
FIG.2
PRIOR ART
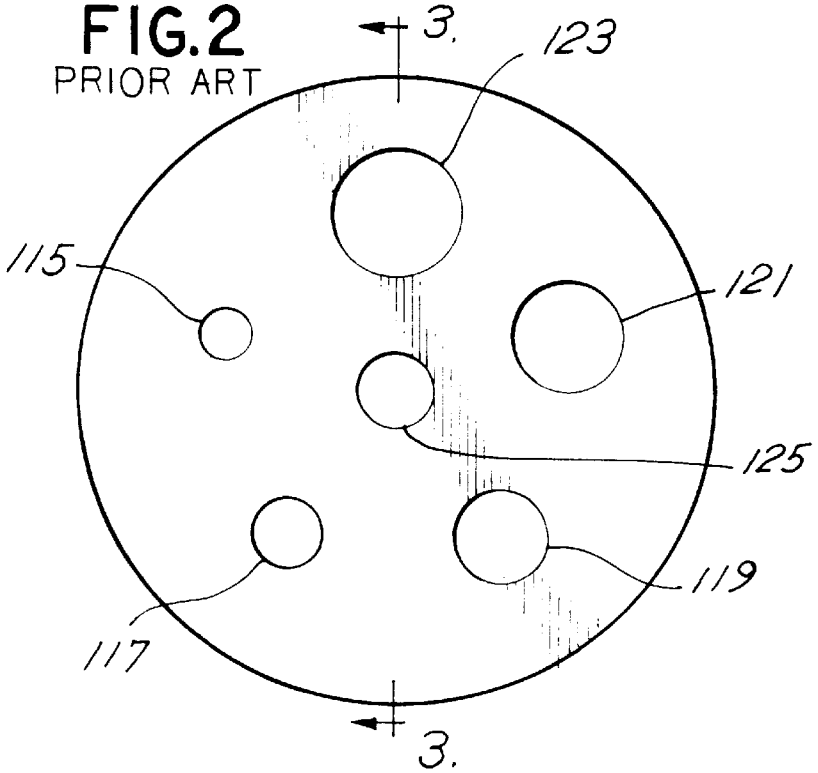
FIG.3
PRIOR ART
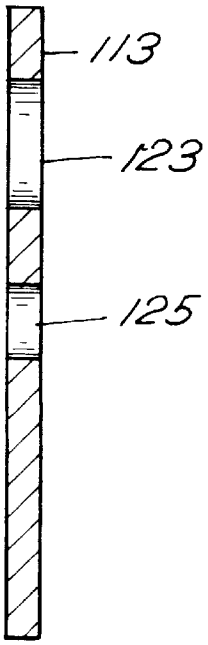

TEXTURE MATERIAL APPLICATOR

BACKGROUND OF THE INVENTION

The present invention relates to an improved texture material applicator, and more particularly, to an applicator having a rotatable orifice plate which includes a plurality of nozzles of differing exit diameters wherein each nozzle has a longitudinal length corresponding to its exit diameter.

A number of devices are available for applying texture material to surfaces such as walls or ceilings of buildings. These texture material applicators have evolved from labor-intensive manual tools to modern powered devices. Modern texture material applicators are often in the form of spray guns. Compressed gas (often air) is used to expel texture material from the spray gun in response to a user operated trigger. A spray gun mounted hopper or a supply line supply texture material to the gun during use.

Such an applicator is shown in U.S. Pat. No. 5,232,161 issued to Clemmons. The Clemmons patent discloses a spray gun applicator having a user-activated spring biased trigger. The texture material enters the spray gun from a source located above the gun. The texture material is then expelled from the gun by means of compressed air which is supplied at the rear of the gun. The texture material is expelled from a mixing orifice at the front of the gun and passes through a pattern defining orifice plate. The pattern defining orifice plate contains a plurality of orifices of differing sizes which may be positioned over the mixing orifice to control the size of the plume of expelled texture material.

One of the measures of quality of texture material application is the consistency of the texture pattern deposited upon the surface. Manual texturing tools which were used in the past provide little control over the consistency of the texture deposition. Modern spray guns, on the other hand, achieve a greater level of deposition consistency. But, even these modern texture material applicators have problems with consistency in deposition and with the copious amounts of material impacting the surface outside the target area.

A pattern defining orifice plate provides some control of the material flow. However, such control is more equivalent to controlling the volume of texture material being expelled rather than controlling the consistency and focus of the deposition pattern. For example, applicators are often unable to sufficiently focus the flow of texturing materials to a specific area on the surface, thus yielding unwanted, widely dispersed deposition patterns. Additionally, applicators may produce, for example, spurting, shifting focus, no focus, or an off-axis focus of the texture material, all of which are undesirable. Such undesirable effects may yield unattractive and inconsistent deposition patterns which may require additional time and resources to rectify or may require extensive time and material for masking.

Others in the art have devised structures in an attempt to improve the consistency of the texture deposition pattern. For example, in U.S. Pat. No. 5,255,846 issued to Ortega, a cylindrical deflector is utilized which tapers outwardly in the direction of texture flow. The deflector is attached to the front of the spray gun so that the texture material is directed through the deflector. The deflector intercepts the portion of the stream of texture material emitted at a wide angle from the axis of the flow. While Ortega may reduce dispersion at large angles from the flow axis, it may not provide a more consistent deposition pattern on the surface.

Thus, a need exists for a texture material applicator capable of depositing a consistent and focused texture pattern upon a surface. Additionally, this need exists for such a spray gun texture material applicator that may be made widely commercially available.

SUMMARY OF THE INVENTION

It is therefore an object of the present invention to provide a texture material applicator capable of depositing a consistent texture pattern upon a surface.

It is another objective of the present invention to provide an inexpensive and durable spray gun texture material applicator which provides a more focused deposition pattern of texture material.

It is yet another objective of the present invention to provide a focused and consistent deposition pattern of texture material with a minimum of material waste and reduced costs attributed to masking.

These and other objects of the present invention are met by a nozzle orifice plate for a texture material applicator. The plate includes a number of nozzle orifices of differing exit diameters. Different diameter orifices have different nozzle lengths.

These and other features of the present invention are discussed or apparent in the following detailed description of the preferred embodiments of the invention.

BRIEF DESCRIPTION OF THE DRAWINGS

FIG. 1 is a perspective view of a conventional, prior art, spray gun applicator.

FIG. 2 is a front view of an orifice plate of the applicator of FIG. 1.

FIG. 3 is a cross-sectional side view of the orifice plate of FIG. 1, taken along sectional lines 2—2.

DETAILED DESCRIPTION OF THE PREFERRED EMBODIMENTS

Figure 4:
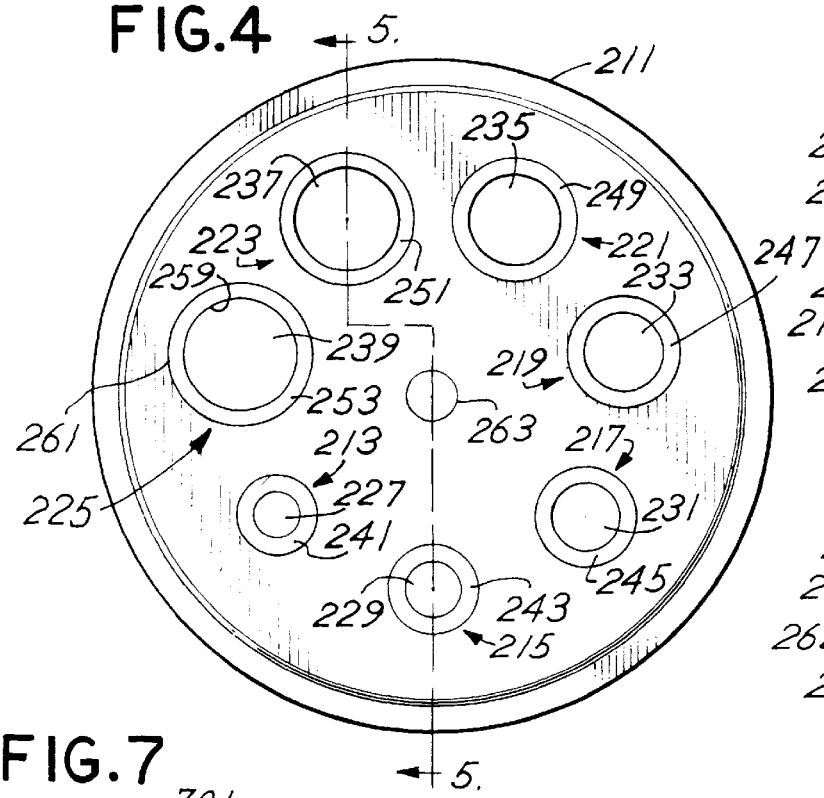
FIG. 4 is a front view of a nozzle orifice plate embodiment according to the present invention.

Referring to FIGS. 1, 2 and 3, a conventional prior art spray gun applicator 111 includes a pattern definition plate or orifice plate 113. Plate 113 is a solid circular plate of a single thickness and having a plurality of flow orifices 115, 117, 119, 121, 123. An attachment aperture 125 is centrally located in the plate. Plate 113 is rotatably mounted onto a threaded bolt 127, which protrudes from the front end of spray gun 111. Each of the flow orifices 115–123 are of differing diameters and each may be rotatably positioned over a texture mixing orifice 121 of the spray gun. Rotation of plate 113 allows the positioning of a selected one of the various sizes of flow orifices 115–123 to control the texture material flow from the gun to the surface (not shown) which is being sprayed.

Figure 5:
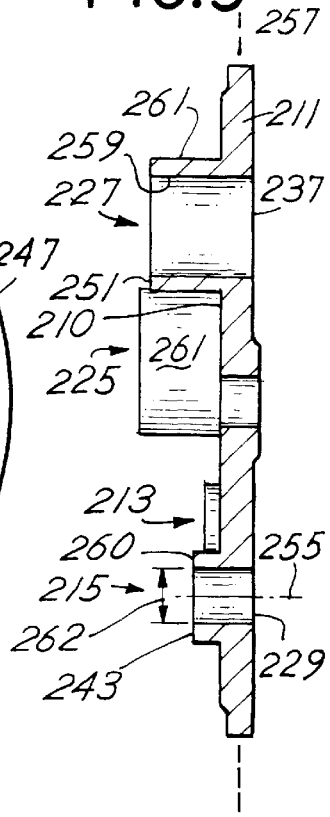
FIG. 5 is a cross-sectional side view of the nozzle orifice plate of FIG. 4, taken along sectional lines 5—5.

Referring now to FIGS. 4 and 5, according to an embodiment of the present invention, a base plate 211 is cylindrical in shape and includes seven spray pattern control orifices 227, 229, 231, 233, 235, 237, 239. Each of the orifices 227–239 is formed by a nozzle 213, 215, 217, 219, 221, 223, 225. Each nozzle 213–225 is constructed from a portion of base plate 211 and a respective cylindrical wall member which forms a hollow tube 241, 243, 245, 247, 249, 251, 253.

Each tube 241–253 extends from the outer surface 210 of base plate 211 along an axis (for example axis 255) perpendicular to the plane 257 of base plate 211. Each tube 241–253 includes an interior cylindrical surface 259 and a cylindrical outer surface 261. A distal end 260 of each tube defines an exit diameter 262.

The inner diameter of the tube need not be constant throughout, but any inner diameter changes should be smooth. The interior surface 261 of the tube may not define a cylinder, and may define other shapes including a cone. Interior surface 261 may be slightly conical, if desired, to provide a draft angle to allow molding of the wall member.

The base plate 211 is affixed to a conventional texture material applicator 111 (FIG. 1) via a centrally located aperture 263 formed in the base plate. The base plate may be affixed to the applicator by various means, for example, by placing the aperture 263 onto threaded bolt 127 and securing the plate to the bolt by a nut 129 and washer 131 (FIG. 1).

The base plate 211 may be made of various solid materials capable of withstanding the stress of the operation of the texture material applicator, for example, plastic, or steel. Each of the nozzles 213–225 may be composed of the same material as the base plate 205. Preferably, the base plate 211 and nozzles 213–225 are cast as a single piece of plastic.

Base plate 211 is of sufficient thickness to withstand the stress of operation of the texture material applicator. Thus, the thickness of base plate 211 may vary depending upon the type of solid material of which it is composed. For example, a thickness of approximately 0.10 inches may be satisfactory for a plastic base plate.

Base plate 211 also is of sufficient diameter to rotatably position, one at a time, each of the nozzles 213–225 over the texture material mixing aperture 121 (FIG. 1). A base plate diameter of approximately 2.5 to 3.0 inches is sufficient.

The spacing of the nozzles 213–225 around the base plate 211 and the number of nozzles may vary as long as sufficient angular spread exists between the nozzles to ensure that a single nozzle orifice may be used in isolation to receive material from the texture mixing aperture 121. The nozzle orifices 227–239 proceed in sequence around the base plate from smallest to largest exit diameters as the base plate is rotated. However, the nozzle orifices 227–239 may be ordered in different sequences, not according to size, without altering the effectiveness of the applicator.

As will suggest itself, the base plate 211 may conform to a variety of geometric embodiments other than circular, and still enable a selection of one of the texture material orifices 227–229. For example, the base plate may be configured with nozzles aligned linearly upon a rectangular base plate or strip. The rectangular base plate may then be displaced linearly (instead of rotatably) vertically or horizontally to selectively position a nozzle in front of the corresponding texture material emitting aperture in the texture material applicator.

In operation, texture material is forced through the texture material mixing aperture 121, and then the material passes through a selected texture material flow orifice 227–239 of the base plate 211 and nozzles 213–225. The texture material passes through the nozzle orifice predominantly in a direction normal to the plane of the base plate 211. Upon passing through the selected nozzle orifice, the texture material moves through a distance of air until the texture material contacts a surface.

Each tube 241–253 extends from the base plate along its longitudinal axis in a direction normal to the plane of the base plate, forming a nozzle 213–225. Each nozzle 213–225 has a length which is comprised of the total longitudinal distance of texture material flow through the base plate 211 and the respective tube 241–253. That is, the nozzle length is the thickness of the base plate 211 plus the longitudinal extent of the wall member beyond the base plate. For example, a texture material flow orifice in a 0.1 inch thick base plate with a tube extending 0.1 inches from the base plate yields a total nozzle length of 0.2 inches.

Each nozzle 213–225 extends a length dependent upon its exit diameter. Texture material orifice 237 is larger in exit diameter than orifice 229. Thus, tube 251 (which defines the exit diameter of orifice 237) extends a greater distance above the top surface of base plate 211 than tube 243 (which defines the exit diameter of orifice 229).

The uniformity of the texture material deposition pattern is favorably increased by conforming the total nozzle length to between 0.5 times and 1.5 times the exit diameter of the nozzle orifice. Most preferred is a nozzle length approximately equal to its exit diameter. For example, the following chart shows in ascending nozzle size, the diameter at the exit of the nozzle in inches, and the nozzle length in inches. The nozzle length is the sum of the base plate thickness and the length of the tube extending above the top or outer surface of the base plate.

| Nozzle Drawing (#) | Exit Diameter of Nozzle (in inches) | Nozzle Length (in inches) |
|---|---|---|
| 213 | 0.197 | 0.197 |
| 215 | 0.236 | 0.236 |
| 217 | 0.276 | 0.276 |
| 219 | 0.313 | 0.313 |
| 221 | 0.375 | 0.375 |
| 223 | 0.419 | 0.419 |
| 225 | 0.466 | 0.466 |

From the values above, it can be seen that the exit diameter of the nozzle orifices monotonically increases, but do not linearly increase.

Figure 6:
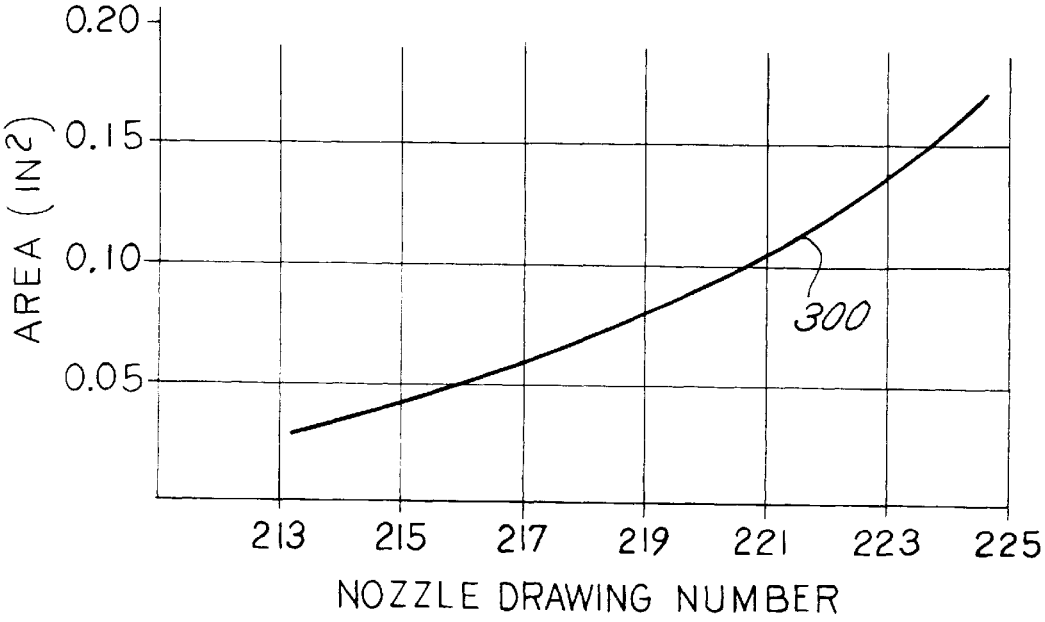
FIG. 6 is a graph of the relationship between the cross-sectional area of the nozzle orifice at its exit and the particular numbered nozzle in the plate of FIG. 4.

FIG. 6 illustrates a graph of the relationship between the cross-sectional area of the nozzle orifices at their exit diameters and their respective nozzle drawing number in FIG. 4. The area of the nozzle orifice is found using the geometric expression for the area of a circle:

$$A=\pi r^2$$

or $$A=\pi\frac{D^2}{4}$$

where A is the area in square inches, r is the exit radius in inches, and D is the exit diameter in inches.

In FIG. 6, the vertical axis shows the variance in area of the nozzle orifice at its exit end in square inches from 0.00 to 0.20. The horizontal axis shows the variance in nozzle member. The curve 300 (representing the graphical variance of the nozzle orifice area with respect to nozzle number) curves upward with a slope somewhat greater than linear.

Figure 7:
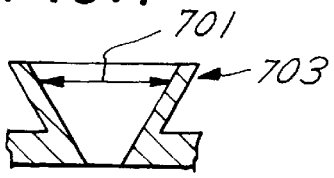
FIG. 7 is a cross-sectional side view of a nozzle.

Additionally, the thickness of the wall of each nozzle may be defined as the radial distance between the cylinder described by the interior wall of the nozzle and the cylinder described by the exterior wall of the nozzle. Each nozzle must have a sufficient thickness to withstand the stress of operation of the texture material applicator and direct the flow of texture material. Although each nozzle in FIG. 2 is of similar wall thickness, the thickness of the nozzle wall may be varied without altering the effectiveness of the present invention. For instance, smaller orifices may be constructed with thinner walls and larger orifices may be constructed with thicker walls, or vice versa. Furthermore, the inside shape and the outside shape of the wall may be conical (as shown in FIG. 7), non-circular, etc.

Where the cross-sectional exit shape of the nozzle (i.e., the two dimensional shape of the orifice at the exit end of the nozzle in a cross-sectional place normal to the longitudinal axis of the nozzle) is non-circular, for example, elliptical or square, etc., the exit diameter of the nozzle is defined as the diameter of the greatest circle which is circumscribed by the exit shape. Thus, the inner diameter of a nozzle need not have a circular crossection. For example, on an oval nozzle orifice still affords the advantages of the present invention. Additionally, the inner diameter of the nozzle may be tapered outward or otherwise configured to increase deposition pattern focus and uniformity.

While particular elements, embodiments and applications of the present invention have been shown and described, it is understood that the invention is not limited thereto since modifications may be made by those skilled in the art, particularly in light of the foregoing teaching. It is therefore contemplated by the appended claims to cover such modifications and incorporate those features which come within the spirit and scope of the invention.

What is claimed is:

1. A nozzle orifice plate for use in a texture material applicator, comprising:

a base plate including a plurality of nozzles, each of said nozzles formed of:

an aperture wall formed in said base plate; and a hollow tube member disposed relative to said aperture wall and extending outwardly from said plate;

each said nozzle having an interior surface defining an exit diameter, each said nozzle having a total length equal to the sum of the thickness of said base plate at said aperture plus the length of said nozzle extending beyond said base plate, and each said nozzle having a length dependent upon said exit diameter.

2. A nozzle orifice plate according to claim 1 wherein the length of each of said nozzles is at least one-half times the length of its respective said exit diameter and no greater than one-and-one-half times the length of its respective said exit diameter.

3. A nozzle orifice plate according to claim 1 wherein the length of each of said nozzles is equal to the length of its respective said exit diameter.

4. A nozzle orifice plate according to claim 1 wherein said interior surface of each of said nozzles is cylindrical and the total length of each said nozzle is proportional to said exit diameter defined by its respective said interior surface.

5. A nozzle orifice plate according to claim 1 wherein said interior surface of each of said nozzles smoothly increases in diameter beyond said base plate and the length of each of said nozzles is proportional to its respective exit diameter defined at the furthest extent of said nozzle beyond said base plate.

6. A texture material applicator comprising:

a base plate having a plurality of nozzles for receiving and expelling texture material;

said plurality of nozzles extending normally from said base plate, each of said nozzles having an interior cylindrical surface defining an exit diameter, at least one said exit diameter of one of said nozzles differing from another said exit diameter of another of said nozzles, each of said plurality of nozzles having a length equal to the sum of the thickness of said base plate plus the extent of said nozzle beyond said base plate.

7. An applicator according to claim 6 wherein the length of each of said plurality of nozzles is between one-half times the length of said exit diameter of said nozzle and one-and-one-half times the length of said exit diameter of said nozzle.

8. An applicator according to claim 6 wherein the length of each of said plurality of nozzles is equal to its respective said exit diameter.

* * * * *